US005364419A

United States Patent [19]

Tack et al.

[11] Patent Number: 5,364,419

[45] Date of Patent: Nov. 15, 1994

[54] FUEL OIL ADDITIVES

[75] Inventors: Robert D. Tack, Abingdon; Darryl R. T. Smith; David P. Gillingham, both of Swindon, all of United Kingdom

[73] Assignee: Exxon Chemical Patents Inc., Linden, N.J.

[21] Appl. No.: 123,307

[22] Filed: Sep. 17, 1993

Related U.S. Application Data

[63] Continuation of Ser. No. 265,623, Nov. 1, 1988, abandoned.

[30] Foreign Application Priority Data

Nov. 2, 1987 [GB] United Kingdom ..... 8725613

[51] Int. Cl.[5] ..... C10L 1/24; C10M 135/10

[52] U.S. Cl. ..... 44/371; 44/370; 44/372; 252/33

[58] Field of Search ..... 44/370, 371, 372

[56] References Cited

U.S. PATENT DOCUMENTS

| | | | |
|---|---|---|---|
| 2,906,613 | 9/1959 | Mills | 44/372 |
| 2,948,596 | 8/1960 | Ambose et al. | 44/371 |
| 3,033,665 | 5/1962 | Gaston et al. | 44/66 |
| 3,116,128 | 12/1963 | Fareri et al. | 44/71 |
| 3,578,422 | 5/1971 | Dorer, Jr. | 44/372 |
| 3,961,916 | 6/1976 | Ilnyckyj et al. | 44/62 |
| 4,059,414 | 11/1977 | Holtz et al. | 44/372 |
| 4,105,418 | 8/1978 | Mohnhaupt | 44/372 |
| 4,113,443 | 9/1978 | Spence | 44/371 |
| 4,211,534 | 7/1980 | Feldman | 44/62 |
| 4,620,855 | 11/1986 | Higgins | 44/371 |
| 5,215,548 | 6/1993 | Ashcraft et al. | 44/372 |

FOREIGN PATENT DOCUMENTS

| | | |
|---|---|---|
| 17690A1 | 10/1980 | European Pat. Off. . |
| 61895A2 | 10/1982 | European Pat. Off. . |

OTHER PUBLICATIONS

Journal of Institute of Petroleum, "New Laboratory Test for Predicting Low-temperature Operability of Diesel Fuels", vol. 52, No. 510, Jun. 1966, pp. 173–185.

*Primary Examiner*—Ellen M. McAvoy
*Attorney, Agent, or Firm*—V. T. White

[57] ABSTRACT

A liquid hydrocarbon particularly fuel oil containing an amine-salt having the formula

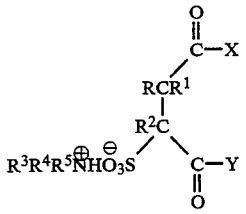

wherein

R, $R^1$ and $R^2$ are hydrogen or a hydrogen - and carbon-containing group;

$R^3$ and $R^4$ are hydrogen or hydrogen - and carbon containing groups containing at least 12 carbon atom;

$R^5$ is a hyrdrogen-and carbon-containing group containing at least 12 carbon atoms;

X is $—OR^6$, $NR^7R^8$ or $[—O]^-{+}[NHR^9R^{10}R^{11}]$ and Y is $—OR^{12}$, $NR^{13}R^{14}$ or $[—O]^-{+}[NHR^{15}R^{16}R^{17}]$ where $R^6$, $R^7$, $R^8$, $R^9$, $R^{10}$, $R^{13}$, $R^{14}$, $R^{15}$ and $R^{16}$ are hydrogen or hydrogen and carbon containing groups, and $R^{11}$ and $R^{17}$ are hydrogen - and carbon containing groups; provided that $R^3$, $R^4$ and $R^5$ cannot all be alkyl groups.

19 Claims, No Drawings

FUEL OIL ADDITIVES

This is a continuation, of application Ser. No. 265,623, filed Nov. 1, 1988, now abandoned, which is based on UK87-25613 filed Nov. 2, 1987.

This invention relates to additives for liquid hydrocarbons such as lubricants and fuels, in particular the invention relates to fuel oils, containing such additives which act as wax crystal modifiers.

Heating oils and other distillate petroleum fuels, e.g., diesel fuels, contain normal paraffin hydrocarbon waxes which, at low temperatures, tend to precipitate in large crystals in such a way as to set up a gel structure which causes the fuel to lose its fluidity. The lowest temperature at which the fuel will still flow is generally known as the pour point. When the fuel temperature reaches or goes below the pour point and the fuel no longer flows freely, difficulty arises in transporting the fuel through flow lines and pumps, as for example when attempting to transfer the fuel from one storage vessel to another by gravity or under pump pressure or when attempting to feed the fuel to a burner. Additionally, the wax crystals that have come out of the solution tend to plug fuel lines, screens and filters. This problem has been well recognised in the vast and various additives have been suggested for depressing the pour point of the fuel oil. One function of such pour point depressants has been to change the nature of the crystals that precipitate from the fuel oil, thereby reducing the tendency of the wax crystals to set into a gel. Small size crystals are desirable so that the precipitated wax will not clog the fine mesh screens that are provided in fuel transport, storage, and dispensing equipment. It is thus desirable to obtain not only fuel oils with low pour points (flow points) but also oils that will form small wax crystals so that the clogging of filters will not impair the flow of the fuel at low operating temperatures.

Effective wax crystal modification (WCM) and consequent cold flow improvement is measured by CFPP (Cold Filter Plugging Point) and other operability tests, as well as by Cold Climate Chassis Dynamometer and, obviously, field performance. Such WCM can be achieved by flow improvers, usually ethylene-vinyl acetate copolymer (EVAC) based, in distillates containing up to 4% -n-paraffin at 10° C. below cloud point, as determined by gravimetric or DSC methods. Additive response in these distillates is normally stimulated by adjusting ASTM D-86 distillation characteristics of these distillates (increase of [FBP—90%] tail to more than 20° C. and distillation range [90-20]% dist. to values above 100° C., FBP above 355° C.).

These EVAC flow improvers are not however effective when treating high wax content distillates, like those encountered in the Far East, which although featuring mostly similar distillation characteristics, (e.g., [FBP—90%] dist. and [90-20]% dist. range) have much higher wax content (between 5 and 10%) and different carbon number distribution, particularly in the $C_{22}$ plus range.

In treating fuels, we used additives to achieve different effects, improvement in low temperature flow, inhibition of wax settling, reduction in foaming tendencies, reduction in corrosion, etc. We have now discovered additives for liquid hydrocarbons such as lubricants and fuel oils, and which are particularly useful for improving the properties of distillate fuels. These additives are certain amine salts which have considerable advantages over previous proposals for distillate fuels and surprisingly the addition of these amine salts also reduces or eliminates a foaming in diesel fuels, and inhibits the corrosion of steel by water (or brine) that might be entrained in the fuel. Such multifunctionality is normally achieved by blends of several components and the use of a multifunctional additive can reduce overall additive concentration and avoids problems caused by interaction of incompatible additives in a concentrate.

According to this invention a liquid hydrocarbon composition comprises a major proportion by weight of a liquid hydrocarbon and a minor proportion by weight of an amine or diamine salt of (a) a sulphosuccinic acid, (b) an ester or diester of a sulphosuccinic acid (c) an amide or a diamide of a sulphosuccinic acid, or (d) an ester-amide of a sulphosuccinic acid. This invention also includes the use as a wax crystal modifier in a fuel oil of an amine or diamine salt of (a) a sulphosuccinic acid, (b) an ester or diester of a sulphosuccinic acid (c) an amide or a diamide of a sulphosuccinic acid, or (d) an ester-amide of a sulphosuccinic acid.

The amine salts preferably have the general formula:

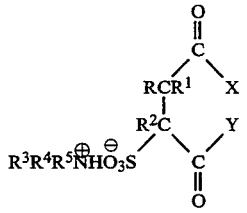

wherein

R, $R^1$ and $R^2$ are hydrogen or a hydrogen - and carbon containing group;

$R^3$ and $R^4$ are hydrogen or hydrogen - and carbon contain groups containing at least 12 carbon atoms;

$R^5$is a hydrogen and carbon containing group containing at least 12 carbon atoms:

X is $—OR^6$, $—NR^7R^8$ or $[—O]^{-}+[NHR^9R^{10}R^{11}]$ and

Y is $—OR^{12}$ $—NR^{13}R^{14}$ or $[—O]^{-}+[NHR^{15}R^{16}R]$ where $R^6$, $R^7$, $R^8$, $R^9$, $R^{10}$, $R^{12}$, $R^{13}$, $R^{14}$, $R^{15}$ and $R^{16}$ are hydrogen or hydrogen and carbon containing groups, provided $R^6$ and $R^{12}$ cannot both be hydrogen; and $R^{11}$ and $R^{17}$ are hydrogen - and carbon containing groups; provided that $R^3$, $R^4$ and $R^5$ cannot all be alkyl groups.

Thus the sulphosuccinates (esters) have the structure:

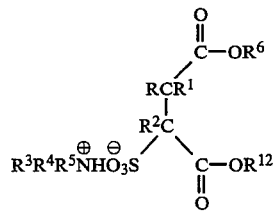

the diamides of a sulphosuccinic acid have the structure:

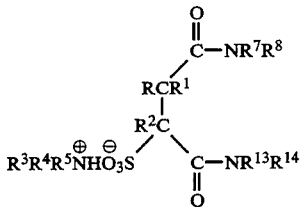

the monoamides of a sulphosuccinic acid have the structures:

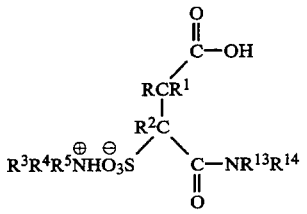

or

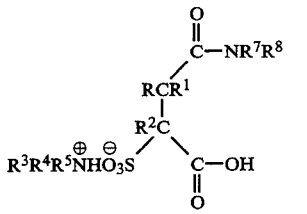

the ester amide of a sulphosuccinic acid have the structures:

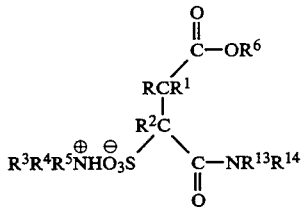

or

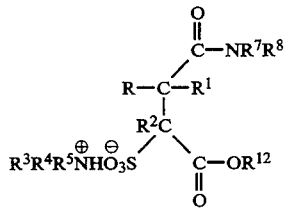

and the sulphosuccinates (carboxylate salts) include those of the structure:

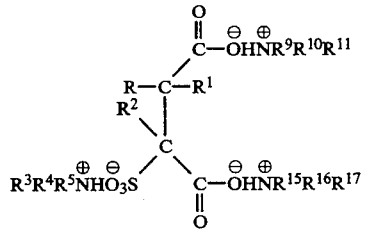

-continued and

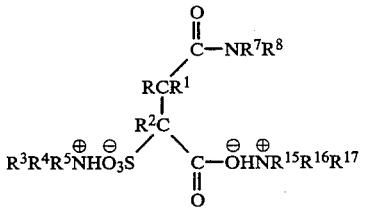

It should be appreciated that the amine salts can include structures based on two or more sulphosuccinate residues linked together e.g. , by ester linkages, e.g.,

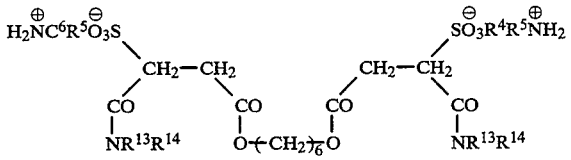

Generally it is preferred that at least one of the R groups in X and Y is relatively long chain, i.e., contains at least 6 and preferably 12 carbon atoms. When this condition is met one or some of the other R groups or of the groups $R^3$, $R^4$ and $R^5$ can be relatively short chain, e.g., methyl.

In the general formula for the amine salts:

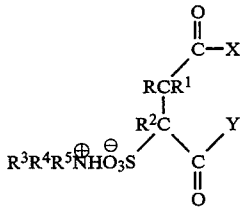

the groups $R^1$ and $R^2$ may, for example, be a hydrocarbyl groups such as methyl or ethyl. However preferably $R^1$ and $R^2$ are hydrogen atoms. The group R can also be a hydrocarbyl group, for example an alkyl, alkenyl or aralkyl group. Preferred alkyl groups are straight or branched chain groups, for example those containing 1 to 30 carbon atoms, in particular 10 to 20 carbon atoms such as dodecyl, tetradecyl, hexadecyl or octadecyl. Alternatively R may be hydrogen.

Regarding the amine $R^3R^4R^5N$ from which all the amine salts are derived, it is preferred that $R^3$,$R^4$ and $R^5$ are not all alkyl and it is preferred that they cannot all be hydrogen-and carbon containing groups. It is preferred that at least one of $R^3$ and $R^4$ is hydrogen, i.e., that the amine is a primary amine or a secondary amine rather than a tertiary amine. $R^5$ and, when not hydrogen, $R^3$ can for example be hydrocarbyl groups especially alkyl, aralkyl, alkaryl or cycloalkyl groups, although they could be alkenyl or alkinyl groups. The alkyl, alkenyl or alkinyl and the alkyl portion of the alkaryl and aralkyl groups can be branched but are preferably straight chain. Preferred alkalyl groups contain 12 to 30, especially 14 to 22 carbon atoms and preferred alkyl and aralkyl groups contain 12 to 36 carbon atoms. Especially preferred alkyl groups are $C_{12}$ to $C_{20}$ alkyl groups, e.g., tetradecyl, hexadecyl, octadecyl, eicosyl or a mixture, such as hexadecyl/octadecyl.

Preferred amines from which the amine salt is derived are $R^4R^5NH$ and $R^5NH_2$, where $R^4$ and $R^5$ are hydrocarbyl groups especially alkyl groups.

Concerning the esters:

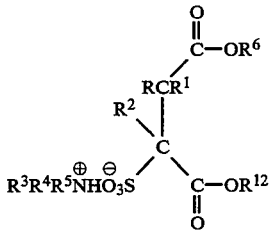

the diesters, i.e., where $R^6$ and $R^{12}$ are both hydrogen and carbon containing groups, are preferred to the monoesters, i.e., where one of $R^6$ and $R^{12}$ is hydrogen and the other a hydrogen-and carbon-containing group. It is preferred that $R^6$ and/or $R^{12}$ are linear long chain alkyl. The alkyl group can be straight or branched chain. Preferably the alkyl group contains 6 to 30, especially 10 to 22 carbon atoms. Examples are decyl, tetradecyl, pentadecyl, hexadecyl, nonadecyl and docosyl. Other suitable examples for $R^6$ and $R^{12}$ are tolyl, 4-decyl phenyl, cyclooctyl or mixtures for example hexadecyl-/octadecyl, hexadecyl/eicosyl, hexadecyl/docosyl or octadecyl/docosyl.

The diesters may be obtained by reacting a fumarate and maleate ester with excess water and an amine in the presence of a solvent and bubbling in sulphur dioxide.

For the ester amines:

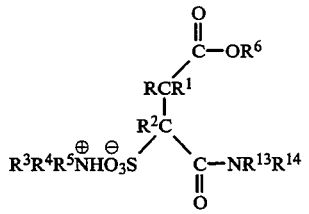

or

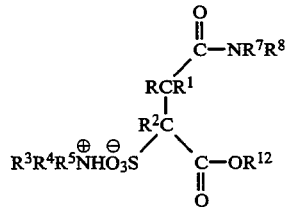

and for diamides:

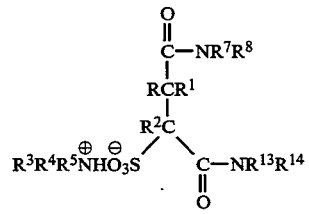

it is preferred that all the groups $R^6$, $R^7$, $R^8$, $R^{12}$, $R^{13}$ AND $R^{14}$ are hydrogen and carbon containing groups, especially hydrocarbyl groups, such as alkyl groups. In general, the preferred and exemplified hydrogen and carbon containing groups $R^7$, $R^8$, $R^{13}$ and $R^{14}$ are the same as the groups $R^3$, $R^4$ and $R^5$ described above, and the preferred and exemplified groups $R^6$ and $R^{12}$ are as described above. In particular, it is preferred that the ester-amide or diamide be a mixture of ester-amides or diamides where $R^7$ and $R^{13}$ are hexadecyl groups and $R^8$ and $R^{14}$ are octadecyl groups.

The monoamides are less preferred but the preferred and exemplified hydrogen and carbon containing groups $R^7$ and $R^8$ or $R^{13}$ and $R^{14}$ are as above described in connection with the diamides.

The ester-amides may be prepared by reacting dimethyl maleate or a substituted dimethyl maleate with excess water and an amine in the presence of a solvent and bubbling in sulphur dioxide. This product, the amine sulphonate of the dimethyl ester of a sulphosuccinic acid, is thereafter reacted with a further molar proportion of the amine to obtain the ester-amide. Reaction of this ester-amide with a further molar proportion of the amine will result in the formation of the diamide. To make the monoamide the procedure for making the ester-amide is followed, except that maleic acid or arthydride or a substituted maleic acid or anhydride is used, instead of the dimethyl ester.

Regarding the carboxylate salts of the amine sulphosuccinates, both carboxylic groups may be neutralised by primary, secondary or tertiary amine ($R^9$, $R^{10}$, $R^{11}N$ and $R^{15}$, $R^{16}$, $R^{17}N$) or only one of the carboxylic groups. the other carboxylic group may be esterified (i.e., with $R^6OH$ or $R^{12}OH$), amidised (i.e., with $R^7R^8$ NH or $R^{13}$ $R^{14}NH$) or be unreacted (i.e., remain —COOH). It is preferred that both carboxylic groups are neutralised by a primary, secondary or tertiary amine. The preferred classes and specific examples for the groups $R^9$, $R^{10}$, $R^{11}$ $R^{15}$, $R^{16}$ and $R^{17}$ are the same as for the groups $R^3$, $R^4$ and $R^5$. Thus it is preferred that at least one of $R^9$ and $R^{10}$ and of $R^{14}$ and $R^{15}$ is hydrogen.

When one of the carboxylic groups is esterified or amidised, the preferred classes and specific examples for $R^6$, $R^{12}$, $R^7$, $R^8$, $R^{13}$ or $R^{14}$ are as previously described.

The carboxylic salts of the amine sulphosuccinates may be prepared by reacting maleic arthydride with an amine and excess water and bubbling in sulphur dioxide to make the carboxylate salt, amide of the sulphosuccinate. To make the carboxylate salt, ester of the sulphosuccinate, one uses a mixture of an amine and an alcohol, instead of just the amine.

The amine salts are added to liquid hydrocarbons such as lubricating oils, fuels such as gasoline, distillate fuels, heavy fuels, and crude oils, although they are particularly useful as additives for a fuel oil which is preferably a distillate fuel oil.

Generally, the distillate fuel oil will boil in the range of about 120° C. to 450° C. and will have cloud points usually from about −30° C. to 20° C. The fuel oil can comprise straight run, or cracked gas oil, or a blend in any proportion of straight run and themally and/or catalytically cracked distillates, etc. The most common petroleum middle distillate fuels are kerosene, diesel fuels, jet fuels and heating oils. The low temperature flow problem is most usually encountered with diesel fuels and with heating oils.

The amount of amine salt added to the fuel oil is a minor proportion by weight and preferably this is between 0.0001 and 5.0% by weight, for example 0.001 to 0.5% by weight (active matter) based on the weight of the fuel oil.

Other additives which may be included in the fuel oil with the amine salt include, for example, other flow improvers.

The flow improver can be one of the following:

(i) Linear copolymers of ethylene and some other comonomer, for example a vinyl ester, an acrylate, a methacrylate, an ζ-olefine, styrene, etc., (ii) Comb polymers, i.e., polymers with $C_{10}$–$C_{30}$ alkyl side chain branches;

(iii) Linear polymers derived from ethylene oxide, for example, polyethylene thereof;

(iv) Monomeric compounds, for example amine salts and amides of polycarboxylic acids, such as citric acid.

The unsaturated comonomers from which the linear copolymer (i) are derived and which may be copolymerised with ethylene, include unsaturated mono and diesters of the general formula:

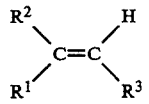

wherein $R^2$ is hydrogen or methyl; $R^1$ is a —$OOCR^4$ group or hydrocarbyl wherein $R^4$ is hydrogen or a $C_1$ to $C_{28}$, more usually $C_1$ to $C_{17}$, and preferably a $C_1$ to $C_8$ straight or branched chain alkyl group or $R^1$ is a —$COOR^4$ group, wherein $R^4$ is as previously described, but is not hydrogen and $R^3$ is hydrogen or —$COOR^4$, as previously defined. The monomer, when $R^1$ and $R^3$ are hydrogen and $R^2$ is —$OOCR^4$ includes vinyl alcohol esters of $C_1$ to $C_{29}$, more usually $C_1$ to $C_{18}$ monocarboxylic acid, and preferably $C_2$ to $C_5$ monocarboxylic acid. Examples of vinyl esters which may be copolymerised with ethylene include vinyl acetate, vinyl propionate and vinyl butyrate or isobutyrate, vinyl acetate being preferred. We prefer that the copolymers contain from 20 to 40 wt. % of the vinyl ester more preferably from 25 to 35 wt. % vinyl ester. They may also be mixtures of two copolymers such as those described in U.S. Pat. No. 3,961,916.

Other linear copolymers (i) are derived from comonomers of the formula:

$$CHR^5{=}CR^6$$

where $R^5$ is H or alkyl, $R^6$ is H or methyl and X is —$COOR^7$ or hydrocarbyl where $R^7$ is alkyl. This includes acrylates, $CH_2{=}COOR^7$,, methacylates, $CH^2{=}CMeCOOR^7$, styrene $CH_2{=}CH.C_6H_5$ and olefins $CHR^5{=}CR^5{=}CR^6R^8$ where $R^8$ is alkyl. The group $R^7$ is preferably $C_1$ to $C_{28}$, more usually $C_1$ to $C_{17}$ and more preferably a $C_1$ to $C_8$ straight or branched chain alkyl group. For the olefins $R^5$ and $R^6$ are preferably hydrogen and $R^8$ a $C_1$ to $C_{20}$ alkyl group. thus suitable olefins are propylene, hexene-1, octene-1, dodecene-1 and tetradecene-1.

For this type of copolymer it is preferred that the ethylene content is 50 to 65 weight % although higher amounts can be used, e.g., 80 wt. % for ethylene-propylene copolymers.

It is preferred that these copolymers have a number average molecular weight as measured by vapour phase osmometry of 1000 to 6000, preferably 1000 to 3000.

Particularly suitable linear Copolymeric flow improvers (i) are copolymers of ethylene and a vinyl ester.

The vinyl ester can be a vinyl ester of a monocarboxylic acid, for example one containing 1 to 20 carbon atoms per molecule. Examples are vinyl acetate, vinyl propionate and vinyl butyrate. Most preferred, however, is vinyl acetate.

Usually the copolymer of ethylene and a vinyl ester will consist of 3 to 40, preferably 3 to 20, molar proportions of ethylene per molar proportion of the vinyl ester. The copolymer usually has a number average molecular weight of between 1000 and 50,000, preferably between 1,500 and 5,000. The molecular weights can be measured by cryoscopic methods, or by vapour phase osmometry, for example by using a Mecrolab Vapour Phase Osmometer Model 310A.

Other particularly preferred linear copolymeric flow improvers are (i) copolymers of an ester of fumaric acid and a vinyl ester. The ester of fumaric acid can be either a mono- or a di-ester and alkyl esters are preferrred. The or each alkyl group can contain 6 to 30, preferably 10 to 20 carbon atoms, and mono- or di-($C_{14}$ to $C_{18}$) alkyl esters are especially suitable, either as single esters or as mixed esters. Generally di-alkyl esters are preferred to mono- esters.

Suitable vinyl esters with which the fumarate ester is copolymerised are those described above in connection with ethylene/vinyl ester copolymers. Vinyl acetate is particularly preferred.

The fumerate esters are preferably copolymerised with the vinyl ester in a molar proportion of between 1.5:1 and 1:1.5, for example about 1:1. These copolymers usually have a number average molecular weight of from 1000 to 100,000, so measured for example by Vapour Phase Osmometry such as by a Mechrolab Vapour Pressure Osmometer.

Comb polymers (ill have the following general formula,

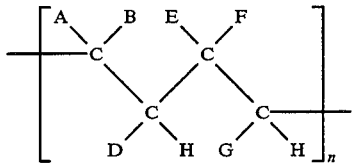

where

A is H, Me or $CH_2CO_2R'$ (where $R'{=}C_{10}$–$C_{22}$ alkyl) (Me=methyl)

B is $CO_2R'$ or R'' (where $R''{=}C_{10}$–$C_{30}$ alkyl, PhR' (Ph=phenyl)

D is H or $CO_2R'$

E is H or Me, $CH_2CO_2R'$

F is OCOR'' ($R'''{=}C_1$–$C_{22}$ alkyl) , $CO_2R'$, Ph, R' or PhR'

G is H or $CO_2R'$ and n is an integer

In general terms, such polymers include a dialkyl fumarate/vinyl acetate copolymer, e.g., ditetradecyl fumarate/vinyl copolymer; a styrene dialkyl maleate ester copolymer, e.g., styrene/dihexadecyl maleate copolymer; a poly dialkyl fumarate, e.g., poly (di-octadecyl fumarate); an alpha-olefin dialkyl maleate copolymer, e.g., copolymer of tetradecene and di-hexadecyl maleate, a dialkyl itaconate/vinyl acetate copolymer, e.g., dihexadecyl itaconate/vinyl acetate; poly-(n-alkyl methacrylates), e.g., poly(tetradecyl methacrylate); poly (n-alkyl acrylates), e.g., poly (tetra decyl acrylate); poly - alkenes, e.g., poly (1-octadecene) etc.

Polymers derived from ethylene oxide (ii) include the poly oxyalkylene esters, ethers, esters/ethers, amide/-esters and mixtures thereof, particularly those containing at least one, preferably at least two $C_{10}$ to $C_{30}$ linear saturated alkyl groups and a polyoxyalkylene glycol group of molecular weight 100 to 5,000, preferably 200 to 5,000, the alkylene group in said polyoxyalkylene glycol containing from 1 to 4 carbon atoms. European patent publication 0 061 985 A2 describes some of these additives.

The preferred esters, ethers or ester/ethers may be structurally depicted by the formula:

$$R—O(A)—O—R^1$$

where R and $R^1$ are the same of different and may be $$\text{n-alkyl} \quad \text{(i)}$$

$$\text{n-alkyl}—\overset{O}{C}— \quad \text{(ii)}$$

$$\text{n-alkyl}—O—\overset{O}{C}—(CH_2)_2— \quad \text{(iii)}$$

$$\text{n-alkyl}—O—c(CH_2)_n—\overset{O}{C}— \quad \text{(iv)}$$

the alkyl group being linear and saturated and containing 10 to 30 carbon atoms, and A represents the polyoxyalkylene segment of the glycol in which the alkylene group has 1 to 4 carbon atoms, such as polyoxymethytene, polyoxyethylene of polyoxyrtrimethylene moiety which is substantially linear; some degree of branching with lower alkyl side chains (such as polyoxypropylene glycol) may be tolerated, but it is preferred the glycol should be substantially linear. Such compounds may contain more than one polyoxyalkylene segment, such as in the esters of ethoxylated amines, and the ester of ethoxylated polyhydroxy compounds.

Suitable glycols generally are the substantially linear polyethylene glycol (PEG) and polypropylene glycols (PPG) having a molecular weight of about 100 to 5,000, preferably about 200 to 2,000. Esters are preferred and fatty acids containing from 10–30 carbon atoms are useful for reacting with the glycols to form the ester additives and it is preferred to use a $C_{18}$–$C_{24}$ fatty acid, especially behenic acids. The asters may also be prepared by esterifying polyethoxylated fatty acids or polyethoxylated alcohols.

Examples of the monomeric compounds as flow improver include polar nitrogen containing compounds, for example an amine salt of, a mono amide or a diamide of, or a half amine salt, half amide of a dicarboxylic acid, tricarboxylic acid or anhydride thereof. These polar compounds are generally formed by reaction of at least one molar proportion of hydrocarbyl substituted amines with a molar proportion of hydrocarbyl acid having 1 to 4 carboxylic acid groups or their anhydrides; ester/amides may also be used containing 30 to 300, preferably 50 to 150 total carbon atoms. These nitrogen compounds are described in U.S. Pat. No. 4,211,534. Suitable amines are usually long chain $C_{12}$–$C_{40}$ primary, secondary, tertiary or quaternary amines, or mixtures thereof, but shorter chain amines may be used provided the resulting nitrogen compound is oil soluble and therefore normally containing about 30 to 300 total carbon atoms. The nitrogen compound preferably contains at least one straight chain $C_8$—$C_{40}$, preferably $C_{14}$ to $C_{24}$ alkyl segment.

The amine salt or half amine salt can be derived from a primary, secondary, tertiary or quaternary amine, but the amide can only be derived from a primary or secondary amine. The amines are preferably aliphatic amines and the amine is preferably a secondary amine in particular an aliphatic secondary amine of the formula $R^1R^2NH$. Preferably $R^1$ and $R^2$ which can be the same or different contain at least 10 carbon atoms, especially 12 to 22 carbon atoms. Examples of amines include dodecyl amine, tetradecyl amine, octadecyl amine, eicosyl amine, cocoamine, hydrogenated tallow amine and the like. Examples of secondary amines include dioctadecyl amine, methyl-behenyl amine and the like. Amine mixtures are also suitable and many amines derived from natural materials are mixtures. The preferred amine is a secondary hydrogenated tallow amine of the formula $HNR_1R_2$ wherein $R_1$ and $R_2$ are alkyl groups derived from hydrogenated tallow fat composed of approximately 4% $C_{14}$, 31%$C_{16}$, 59% $C_{18}$.

Examples of suitable carboxylic acids for preparing these nitrogen compounds (and their anhydrides) include cyclo-hexane, 1,2 dicarboxylic acid, cyclohexane dicarboxylic acid, cyclopentane 1,2 dicarboxylic acid, naphthalene dicarboxylic acid, citric acid and the like. Generally, these acids will have about 5–13 carbon atoms in the cyclic moiety. Preferred acids are benzene dicarboxylic acids such as phthalic acid, terephthalic-acid, and iso-phthalic acid. Phthalic acid or its anhydride is particularly preferred.

One suitable compound is the half amine salt, half amide of the dicarboxylic acid in which the amine is a secondary amine. Especially preferred is the half amine salt, half amide of phthalic acid and dihydrogenated tallow amine—Armeen 2HT (approx 4 wt. % n-$C_{14}$ alkyl, 30 wt. % n-$C_{16}$ alkyl, 60 wt. % n-$C_{18}$ alkyl, the remainder being unsaturated).

Another preferred compound is the diamide formed by dehydrating this amide-amine salt.

Preparation

The method of making the amine salts is illustrated by the preparation of the half ester/half dialkylamide of a dialkyl ammonium sulphosuccinate (S9, Example 3):

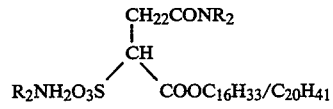

wherein

—$NR_2$ is derived from dihydrogenated tallow amine (Armeen 2HT also referred to as A2HT) and $R^1$ is $C_{16-20}$ alkyl derived from a synthetic alcohol (Alfol 1620).

R = $C_{16}$ to $C_{20}$ n-alkyl (synthetic alcohol)

Referred to herein as A2HT.

The charge composition was as follows:

| Component | Mass % |
|---|---|
| Maleic anhydride | 7.1 |
| Alfol 1620 | 18.4 |
| First Armeen 2HT charge | 35.5 |
| Second Armeen 2HT charge | 35.5 |
| Toluene sulphonic acid (TSA) | 1.4 |

-continued

| Component | Mass % |
|---|---|
| Water | 2.1 |

Xylene—not reactant but used at same wt. proportion as 40 wt. %.

The alcohol (Alfol 1620) plus maleic anhydride and TSA were reacted in xylene as solvent at 60° C. for 1.25 hr. The first charge of A2HT was added and the reaction mixture azeotroped (155° C., Dean & Stark apparatus) for 2 hr. The formation of ester/amide was followed by i.r. (infra-red absorption spectrum). The product was stripped under vacuum to 150° C. Solvent, 2nd charge A2HT and water were added, the mixture heated to 70° C., $SO_2$ passed until absorption complete and i.r. (ester carbonyl) shoved conversion to sulphosuccinate (1 hr.) The solvent was stripped.

The additives of the present invention are conveniently supplied as concentrates in a solvent which is blended with the hydrocarbon liquid. Typically such concentrates contain from 10 to 90 wt. % of the salt at 90 to 10 wt. % of the solvent, preferably from 30 to 70 wt. % of the salt. The concentrates may also contain other additives which may be the components previously described.

The versatility of the additives of the present invention to achieve various effects in distillate fuels is shown in the following examples.

EXAMPLE 1

An amine salt (S1) of a diamide of sulphosuccinic acid having the structure

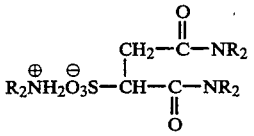

where R is a mixture of $C_{16}/C_{18}$ n-alkyl (obtained from reacting dimethyl maleate with three molar proportions of dihydrogenated tallow amine) was added in various proportions to a distillate diesel fuel A, having the following characteristics:

| D86 distillation | IBP | 20% | 50% | 90% | FBP | 90-20 | Tail |
|---|---|---|---|---|---|---|---|
| °C. | 176 | 216 | 265 | 340 | 372 | 124 | 32 |
| Cloud point | | 0° C. | Base | CFPP | −2° C. | | |

(NB S1 is actually a mixture of products including some imide).

For comparison purposes, an ethylene-vinyl acetate copolymer (C1) containing 13% by weight of vinyl acetate, Mn 3500 was also added in various proportions alone to diesel fuel A and in admixture with the amine salt (S1) in various proportions to diesel fuel A.

Tests were carried out on the treated diesel fuel oils in accordance with the Cold Filter Plugging Point Test (CFPPT), details of which are as follows:

The cold flow properties of the blend were determined by the Cold Filter Plugging Point Test (CFPPT). This test is carried out by the procedure described in detail in "Journal of the Institute of Petroleum", Vol.52, No.510, Jun. 1966 pp 173–185. In brief, a 40 ml sample of the oil to be tested is cooled by a bath maintained at about −34° C. Periodically (at each 1° C. drop in temperature starting from 2° C. above the cloud point) the cooled oil is tested for its ability to flow through a fine screen in a time period. This cold property is tested with a device consisting of a pipette to whose lower end is attached an inverted funnel positioned below the surface of the oil to be tested. Stretched across the mouth of the funnel is a 350 mesh screen having an area of about 0.45 sq.inch. The periodic tests are each initiated by applying a vacuum to the upper end of the pipette whereby oil is drawn through the screen up into the pipette to a mark indicating 20 ml of oil. the test is repeated with each 1° drop in temperature until the oil fails to fill the pipette to a mark indicating 20 ml of oil. The test is repeated with each 1° drop in temperature until the oil fails to fill the pipette within 60 seconds. The results of the test are quoted as CFPP (°C.) which is the fail temperature of the fuel treated with the flow improver.

The results obtained are shown in the following table in which the amounts of C1 and S1 added are shown in parts (by weight) per million (ppm) based on the weight of the fuel.

| C1 (ppm) | S1 (ppm) | CFFP (°C.) |
|---|---|---|
| 200 | 300 | −15.5 |
| 150 | 350 | −16.5 |
| 100 | 400 | −15 |
| 50 | 450 | −14.5 |
| 200 | — | −10.5 |
| 150 | — | −10 |
| 100 | — | −7.5 |
| 50 | — | −5.5 |

The addition of S1 to C1 treated fuel gives improved CFPP depression that is not obtainable by increasing the treat of C1 alone.

EXAMPLE 2

The procedure of Example 1 was repeated using S1 and also in comparison with two diamides A1 and A2. A1 is the diamide prepared by reacting two moles of dihydrogenated tallow amine with one mole of maleic anhydride having the structure

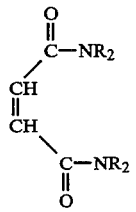

where R is a mixture of $C_{16}/C_{18}$ alkyl and A2 is the diamide of succinic acid having the structure

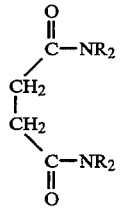

where R is as for A1

The results obtained when subjecting the fuel oil to the CFPPT were as follows:

| C1 (ppm) | S1 (ppm) | A1 (ppm) | A2 (ppm) | CFPP (°C.) |
|---|---|---|---|---|
| 50 | 450 | | | −14.5 |
| 50 | | 450 | | −13 |
| 50 | | | 450 | −11 |
| 25 | 300 | | | −12 |
| 25 | | 300 | | −5.5 |
| 25 | | | 300 | −5.5 |

It can be seen that at the higher treat rate, S1 shows marginally better activity than A1 and A2, whereas at the lower treat rate, S1 shows a notably greater activity than A1 and A2.

EXAMPLE 3

In this example a variety of amine salts of a sulphosuccinic acid were added together with C1 to the diesel fuel A used in example 1.

The structures of the amine salts were as follows

S2 $C_{14}$ fumarate ester/A2HT

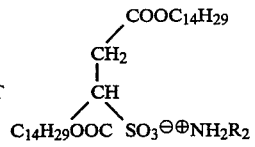

S3 $C_{14}$ maleate ester/A2HT

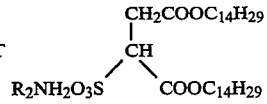

S4 $C_{16}$ fumarate ester/A2HT

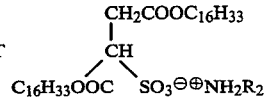

S5 $C_{16}$ fumarate ester/hexadecylamine

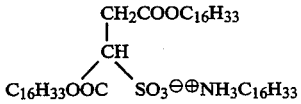

S6 $C_{18/22}$ fumarate ester/A2HT

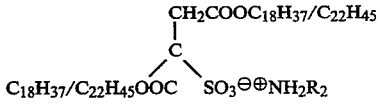

S7 $C_{22}$ fumarate/A2HT

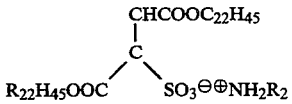

S8 3 × $NHR_2$/Maleic anhydride

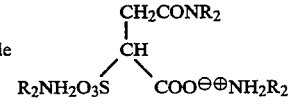

S9 2$NHR_2$, $C_{16-20}OH$/M.A. (mixture of products)

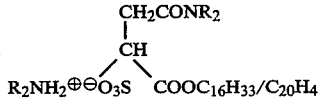

S10 2$NHR_2$/Dimethylmaleate (mixture of products - some imide)

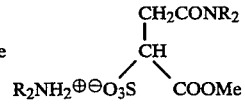

-continued

S1 3$NHR_2$/Dimethylmaleate (mixture of products - some imide)

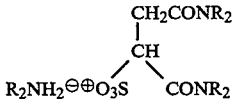

A2HT = $R_2NH$ where R = $C_{16/18}$

When subjected to the CFPPT the results obtained were as follows

| C1 (ppm) | Salt 450 ppm | CFPP (°C.) |
|---|---|---|
| 50 | S2 | −8 |
| 50 | S3 | −6.5 |
| 50 | S4 | −11 |
| 50 | S5 | −8 |
| 50 | S6 | −9 |
| 50 | S7 | −7 |
| 50 | S8 | −13.5 |
| 50 | S9 | −14.5 |
| 50 | S10 | −13 |
| 50 | S1 | −14.5 |

EXAMPLE 4

The procedure of Example 3 was repeated using different concentrations of C1 and the amine salts. The results obtained were as follows:

| C1 (ppm) | Salt 300 (ppm) | CFPP °C. | |
|---|---|---|---|
| 200 | S2 | −12.5 | |
| 200 | S3 | −12.5 | |
| 200 | S4 | −14 | |
| 200 | S5 | −10.5 | |
| 200 | S6 | −10.5 | |
| 200 | S7 | −11.5 | |
| 200 | S8 | −9.5 | |
| 200 | S9 | −14 | |
| 200 | S10 | −13 | |
| 200 | S1 | −13 | |
| 300 | S2 | −11 | |
| 300 | S3 | −13 | |
| 300 | S4 | −15 | |
| 300 | S5 | −8 | |
| 300 | S6 | −14.5 | |
| 300 | S7 | −9 | compared to C1 alone. |
| 300 | S8 | −14 | |
| 300 | S9 | −14 | |
| 300 | S10 | −15 | |
| 300 | S1 | −14 | |
| 200 | — | −10 (±1) | |
| 300 | — | −10 (±1) | |

EXAMPLE 5

In this example to diesel fuel A was added copolymer C1 and various amine salts, A1 and A2, (see Example 2), and a copolymer mixture $C_2$. $C_2$ is a mixture of 38 wt. % of a copolymer of ethylene and vinyl acetate containing 36 wt. % of vinyl acetate, 13 wt. % of C1, 5.75 wt. % of a copolymer of ditetradecyl fumarate and vinyl acetate, 14 wt. % of a copolymer of vinyl acetate and mixed tetradecyl/hexadecyl diesters of fumaric acid and 29.25 wt. % of hydrocarbon solvent.

These compositions were tested for WaxAnti-Settling by cooling the fuel oil composition at 1° C./hour to −6° C. and soaking for 43 hours. The amount of crystals formed or lack of them was observed and the results obtained were as follows, in which F=fluid
sc/mc/lc=small, medium or large crystals
5=wax layer settled to 5% of volume
95/5=two wax layers visible

| | | WAX ANTI-SETTLING (WAS) | | | | | |
|---|---|---|---|---|---|---|---|
| C1 (ppm) | S1 (ppm) | S9 (ppm) | S10 (ppm) | A1 (ppm) | A2 (ppm) | C2 (ppm) | AWAS after 43 hours |
| 100 | — | — | — | — | — | — | 90/5 Gel MC |
| 50 | — | — | — | — | — | — | 90/5 Gel MC |
| 50 | 400 | — | — | — | — | — | 5 F SC |
| 50 | 300 | — | — | — | — | — | 10 F SC |
| 50 | — | 450 | — | — | — | — | NWS F SC (2% layer) |
| 50 | — | — | 450 | — | — | — | NWS F SC (5% layer) |
| 50 | — | — | — | 450 | — | — | 5-10 F SC |
| 50 | — | — | — | — | 450 | — | 30 F SC |
| — | — | — | — | — | — | 450 | 30 F SC |

It can be seen from the table that S1, S9 and S10 in combination with C1 gave better crystal modification (i.e. Small Crystals) than did C1 alone (gave Medium/-Large crystals). S9 and S10, with C1 give better WAS than C1 alone, A1 and A2, and S10, with C1 give smaller crystals that they remain fully dispersed. The good AWAS result for C1 treated fuel is because these samples were Gels (little flow improvement over base fuel).

EXAMPLE 6

Various amine salts (and for comparison $C_1$) were added to a distillate diesel fuel B having the following characteristics.

| D86 distillation | IBP | 20% | 50% | 90% | FBP | 90-20 | Tail |
|---|---|---|---|---|---|---|---|
| | 166 | 217 | 276 | 348 | 370 | 131 | 22 |
| Cloud point | 2° C. | Base | CFPP | −0° C. | | | |

The results obtained when subjecting the diesel fuel oil compositions to the CFPPT were as follows.

| C1 (ppm) | Salt (ppm) | CFPP (° C.) | |
|---|---|---|---|
| 450 | 450 S2 | −4 | All salts show better activity compared to C1 alone at this treat rate, especially S1, S8, S9 and S10. |
| 450 | 450 S3 | −5 | |
| 450 | 450 S4 | −4.5 | |
| 450 | 450 S5 | −4 | |
| 450 | 450 S6 | −5 | |
| 450 | 450 S7 | −5.5 | |
| 450 | 450 S8 | −9 | |
| 450 | 450 S9 | −9.5 | |
| 450 | 450 S10 | −10 | |
| 450 | 450 S1 | −11.5 | |
| 600 | 600 S2 | −5.5 | |
| 600 | 600 S3 | −5.5 | |
| 600 | 600 S4 | −7 | Similar results seen here as above at the higher treat rate. |
| 600 | 600 S5 | −3.5 | |
| 600 | 600 S6 | −7 | |
| 600 | 600 S7 | −5 | |
| 600 | 600 S8 | −10 | |
| 600 | 600 S9 | −11 | |
| 600 | 600 S10 | −12 | |
| 600 | 600 S1 | −11.5 | |
| 450 | — | −2.5 | |
| 600 | — | −2.5 | |

EXAMPLE 7

Example 6 was repeated using fuel oil B except that combinations of different salts, C1 and a copolymer $C_3$, were compared with C1 and $C_3$ alone and in combination. C3 was a copolymer of styrene and a diteteradecyl ester of maleic acid (NN 8000). The results obtained were as follows.

| C1 (ppm) | C3 (ppm) | Salt (ppm) | | CFPP (° C.) | |
|---|---|---|---|---|---|
| 300 | 300 | 300 | S2 | −9.5 | |
| 300 | 300 | 300 | S3 | −9 | All salts show better activity compared to C1/C2 alone at this treat rate |
| 300 | 300 | 300 | S4 | −10.5 | |
| 300 | 300 | 300 | S5 | −3.5 | |
| 300 | 300 | 300 | S6 | −9.5 | |
| 300 | 300 | 300 | S7 | −9 | |
| 300 | 300 | 300 | S8 | −10 | |
| 300 | 300 | 300 | S9 | −10 | |
| 300 | 300 | 300 | S10 | −10 | |
| 300 | 300 | 300 | S1 | −11 | |
| 400 | 400 | 400 | S2 | −10 | |
| 400 | 400 | 400 | S3 | −12 | As above, all salts show better activity at the higher treat rate |
| 400 | 400 | 400 | S4 | −11 | |
| 400 | 400 | 400 | S5 | −11.5 | |
| 400 | 400 | 400 | S6 | −9 | |
| 400 | 400 | 400 | S7 | −11.5 | |
| 400 | 400 | 400 | S8 | −9.5 | |
| 400 | 400 | 400 | S9 | −12 | |
| 400 | 400 | 400 | S10 | −14.5 | |
| 400 | 400 | 400 | S1 | −14 | |
| 300 | 300 | — | | −2.5 | |
| 400 | 400 | — | | −2 | |
| 300 | — | — | | −3 | |
| 400 | — | — | | −4.5 | |
| — | 300 | — | | +1.5 | |
| — | 400 | — | | +0.5 | |

EXAMPLE 8

In this example, various salts were added to fuel oil B. For comparison purposes, a copolymer mixture ($C_4$) consisting of 75 wt. % active ingredient and 25 wt. % hydrocarbon solvent, the active ingredient being 4.5 parts by weight of an ethylene/vinyl acetate copolymer containing 36 wt. % of vinyl acetate units to 1 part by weight of C1, a copolymer of vinyl acetate and di-tetra decyl fumerate ($C_5$) and the reaction product (P1) of phthalic anhydride with dihydrogenated tallow amine ($R^2NH$ where R is $C_{16}/C_{18}$ straight chain alkyl) were also added to fuel oil B. When subjected to CFPPT, the results obtained were as follows:

| C4 (ppm) | C5 (ppm) | salt oY PI (300 ppm) | CFPP (°C.) |
|---|---|---|---|
| 400 | 300 | S2 | −10 |
| 400 | 300 | S3 | −12 |
| 400 | 300 | S4 | −13.5 |
| 400 | 300 | S5 | −12.5 |
| 400 | 300 | S6 | −9 |
| 400 | 300 | S7 | −10 |

-continued

| C4 (ppm) | C5 (ppm) | salt oY PI (300 ppm) | CFPP (°C.) |
|---|---|---|---|
| 400 | 300 | S8 | −9.5 |
| 400 | 300 | S9 | −9 |
| 400 | 300 | S10 | −13 |
| 400 | 300 | S1 | −14.5 |
| 400 | 300 | P1 | −10 |
| 400 | 300 | — | −8 |
| 1000 | — | — | −12 |

All salts above show better activity compared to $C_4/C_5$ alone, especially S3, S4, $S_5$, S10 and S1.

EXAMPLE 9

In this Example, to fuel oil C various salts were added and for comparison purposes C1 and $C_3$. The fuel oil compositions were subjected to YPCT testing and the results obtained were as follows.

The properties of fuel oil C were as follows:

| D86 Distillation °C. | IBP | 20% | 50% | 90% | FBP | 90–20% | Tail |
|---|---|---|---|---|---|---|---|
| | 190 | 246 | 282 | 346 | 372 | 100 | 28 |
| Cloud point 3° C. | | | Base CFPP 0° C. | | | | |

| C1 (ppm) | C2 (ppm) | Salts (ppm) | Mesh passed 500# | 350# |
|---|---|---|---|---|
| 166 | 166 | 166 S3 | X | X |
| 166 | 166 | 166 S4 | X | X |
| 166 | 166 | 166 S5 | X | X |
| 166 | 166 | 166 S8 | X | 35 sec |
| 166 | 166 | 166 S9 | 150 sec | / |
| 166 | 166 | 166 S1 | 20 sec | 190 sec |
| 250 | 250 | — | X | X |

X — Failed to pass the mesh indicated
/ — Passed the mesh indicated, no problem
— Numbers indicate time taken (in seconds) to pass the mesh Results show that both S9 and S1 give better passes compared to that of $C1/C_2$ alone, which do not pass.

EXAMPLE 10

In this example, various salts were added to diesel fuel oil A and for comparison purposes an ethylene/vinyl acetate copolymer ($C_6$) containing 36 weight % of vinyl acetate units (45 wt. % active ingredient, 55 wt. % hydrocarbon solvent), and C1 were also added to fuel oil A. The results of CFPPT were as follows.

| C6 (ppm) | Salt (ppm) | CFPP (°C.) |
|---|---|---|
| 120 | 30 S2 | −5.5 |
| 120 | 30 S3 | −6 |
| 120 | 30 S4 | −11 |
| 120 | 30 S5 | −8.5 |
| 120 | 30 S6 | −15.5 |
| 120 | 30 S8 | −12.5 |
| 120 | 30 S9 | −10 |
| 240 | 60 S2 | −14.5 |
| 240 | 60 S3 | −16 |
| 240 | 60 S4 | −15.5 |
| 240 | 60 S5 | −16.5 |
| 240 | 60 S6 | −18 |
| 240 | 60 S8 | −16 |
| 240 | 60 S9 | −16 |
| 120 | — | −5 (+/−1) |
| 240 | — | −14 |

All salts apart from S2 show better activity compared to that of $C_6$ on its own at both treat rates.

| C6 (ppm) | Salt (ppm) | CFPP (°C.) |
|---|---|---|
| 30 | 120 S2 | −7.5 |
| 30 | 120 S3 | −7.5 |
| 30 | 120 S4 | −7.5 |
| 30 | 120 S5 | −7.5 |
| 30 | 120 S6 | −7 |
| 30 | 120 S8 | −7.5 |
| 30 | 120 S9 | −11 |
| 60 | 240 S2 | −2.5 |
| 60 | 240 S3 | −1.5 |
| 60 | 240 S4 | −2.5 |
| 60 | 240 S5 | 0 |
| 60 | 240 S6 | −3 |
| 60 | 240 S8 | −12 |
| 60 | 240 S9 | −12 |
| 30 | — | −7 |
| 60 | — | −8 |
| — | 150 S2 | −3 |
| — | 150 S3 | −2 |
| — | 150 S4 | −1.5 |
| — | 150 S5 | 0 |
| — | 150 S6 | −3.5 |
| — | 150 S8 | −2.5 |
| — | 150 S9 | −2 |

At the lower treat rate (150 total) only S9 shows better activity compared to C1 alone and at the higher treat rate, both S9 and S8 show better activity compared to C1 alone.

EXAMPLE 11

Various sulphosuccinate salts were added to a Japanese diesel fuel oil (D) having the following characteristics.

| D86 Distillation °C. | IBP | 20% | 50% | 90% | FBP | 90–20% | Tail |
|---|---|---|---|---|---|---|---|
| | 231 | 273 | 292 | 331 | 350 | 58 | 19 |
| Cloud point −3° C. | | | Base CFPP −5° C. | | | | |

For comparison purposes, a mixture (M) of 56 parts by weight of di $C_{12}/C_{14}$ alkyl fumarate and 14 parts of by weight of, a mixture of polyethylene glycol dibehenates of MW 200, 400 and 600 (70% active ingredient 30% hydrocarbon solvent) was also added to C.

The results of the CFPPT were as follows:

| M (ppm) | S8 (ppm) | S9 (ppm) | S1 (ppm) | CFPP (°C.) |
|---|---|---|---|---|
| 480 | 120 | | | −10.5 |
| 480 | | 120 | | −10.5 |
| 480 | | | 120 | −8.5 |
| 300 | 300 | | | −7.5 |
| 300 | | 300 | | −7 |
| 300 | | | 300 | −5.5 |
| 480 | | | | −5 |
| 300 | | | | −5 |

All salts enhance the activity of M with the salt/M ratio at ¼ showing the greatest CFPP compared to M alone.

EXAMPLE 12

To diesel fuel oil B various salts and for comparison purposes various other additives were added.

The salts were S9 and the following:

S11 C16/20 alcohol/2 moles A2HT/maleic anhydride

-continued

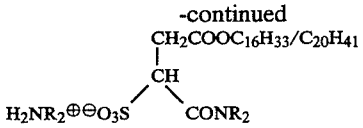

S12 C6 alcohol/2 moles A2HT/maleic anhydride

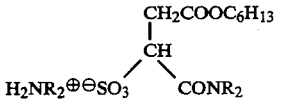

S13 C6 diol/2 moles A2HT/maleic anhydride

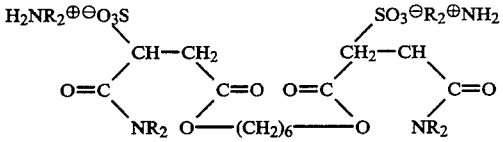

S14 C12 alcohol/2 moles A2HT/maleic anhydride

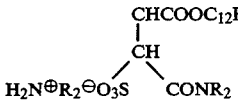

$C_6$ was a copolymer of di $C_{12}/C_{14}$ alkyl fumarate and vinyl acetate and $C_7$ was a copolymer of di $C_{14}/C_{16}$ alkyl fumarate and vinyl acetate.

The results of CFPFT were as follows.

| S9 (ppm) | C1 (ppm) | C6 (ppm) | C5 (ppm) | C7 (ppm) | CFPP (°C.) |
|---|---|---|---|---|---|
| 400 | 50 | | | | −13.5 |
| 400 | 50 | 50 | | | −15.5 |
| 400 | 50 | | 50 | | −14.5 |
| 400 | 50 | | | 50 | −9 |
| — | 50 | | | | −5.5 |

| S12 (ppm) | S14 (ppm) | S11 (ppm) | S13 (ppm) | C4 (ppm) | C1 (ppm) | CFPP (°C.) |
|---|---|---|---|---|---|---|
| — | — | — | — | 500 | — | −16 |
| 250 | | | | 250 | | −12.5 |
| | 250 | | | 250 | | −17.5 |
| | | 250 | | 250 | | −17.5 |
| | | | 250 | 250 | | −16.5 |
| 100 | | | | 400 | | −15.5 |
| | 100 | | | 400 | | −17.5 |
| | | | | 400 | | −17.5 |
| | | 100 | | 400 | | −17.5 |
| | | | 100 | 400 | | −17.5 |

The Table at the top above shows the salts enhancing the activity of C1 alone and also increased activity by adding $C_{12/14}$ and $C_{14}$FVAs ($C_6$ and $C_5$). The bottom Table shows that the sulphosuccinates S14, S11 and S13 show greater activity than $C_4$ alone at the same total treat at both ratios.

EXAMPLE 13

Previously described copolymer C1 and $C_3$ and product A1 and salt S11 were added to a fuel oil E having the following characteristics.

Fuel E

| D86 Distillation | IBP | 20% | 50% | 90% | FBP | 90-20% | Tail |
|---|---|---|---|---|---|---|---|
| °C. | 188 | 249 | 290 | 352 | 380 | 103 | 28 |
| Cloud point +3° C. | | | | Base CFPP 0° | | | |

The results of CFPP and WAS testing (details Example 5) in this fuel (10 g samples) were as follows: ppm of:

| C1/C3 = ¼ | S11 | A1 | CFPP | WAS, −4° C. 8 hrs |
|---|---|---|---|---|
| 100 | 100 | — | −11 | NWS |
| 150 | 150 | — | −13 | NWS |
| 200 | 200 | — | −13 | NWS |
| 100 | — | 100 | −9 | 20 |
| 150 | — | 150 | −13 | 25 |
| 200 | — | 200 | −15 | 30 |

It can be seen that better results are given by using a combination of S11 with $C1/C_3$ than a combination of A1 with C1/C3.

EXAMPLE 14

In this example, the anti-rust properties of sulphosuccinate salt S9 (see Example 3) were tested and compared with those of an ethylene/vinyl acetate copolymer (X) conventionally used as a middle distillate flow improver.

The test was ASTM D665 'A' and 'B' (IP 135 equivalent) using mild steel bullets.

The results obtained are given below, from which it can be seen that S9 shows considerably better anti-rust properties than X.

| Additive | % rust coverate after exposure to: Distilled Water | Brine |
|---|---|---|
| None | 4 | 95 |
| X | 4 specks | 80 |
| S9 | 0 | 15 |

EXAMPLE 15

The anti-foaming characteristics of these sulphosuccinates S8, S9 and S3 in diesel fuel were determined by the following test and compared with two copolymers. The additives, at the prescribed treat rates, were added to 100 g fuel samples, in 120 g screw top bottles. Antifoam testing was carried out on those samples at one hour and at 24 hours after addition. The fuel samples were agitated (of 18° C.) for 60 seconds in a 'Stuart' flask shaker, on speed setting 8 to 10 (shake with sawtooth wavefoam, frequency of about 12 per sec) amplitude 10 to 15 mm). When agitation is stopped, the time taken for foam to clear, down to leaving an area of the surface clear of foam (a distinct point), is noted. The shorter this time, the better the antifoam characteristics of the additive.

The results were as follows:

| Additive: ppm S8 | S9 | S3 | Ethylene/ Propylene Copolymer | Ethylene/ Vinyl Acetate copolymer | Time to foam Clearance (sec) 1 hour (after addition) | 24 hour |
|---|---|---|---|---|---|---|
| 166 | — | — | — | — | 0 | 12 |
| — | 166 | — | — | — | 0 | 0 |
| — | — | — | 166 | — | 7 | 5 |
| 166 | — | — | 166 | — | 0 | 12 |
| — | 166 | — | 166 | — | 0 | 3 |
| — | — | 166 | 166 | — | 5 | 4 |
| — | — | — | 166 | — | 30 | 37 |
| 166 | — | — | — | 166 | 6 | 13 |
| — | 166 | — | — | 166 | 0 | 0 |
| — | — | 166 | — | 166 | 4 | 5 |

-continued

| Additive: ppm | | | Ethylene/ Propylene Copolymer | Ethylene/ Vinyl Acetate copolymer | Time to foam Clearance (sec) 1 hour (after addition) | 24 hour |
|---|---|---|---|---|---|---|
| S8 | S9 | S3 | | | | |
| — | — | — | — | 166 | 35 | 48 |
| 166 | — | — | 166 | 166 | 0 | 9 |
| — | 166 | — | 166 | 166 | 0 | 0 |
| — | — | 166 | 166 | 166 | 4 | 5 |
| — | — | — | 166 | 166 | 45 | 49 |
| No additive, Base fuel | | | | | 35 | 43 |
| Base Fuel with conventional, silicone Antifoam | | | | | 12 | 18 |

We claim:

1. A composition comprising a major proportion by weight of a liquid hydrocarbon and a minor proportion by weight of an amine or diamine sulphosuccinicate derivative of the following formula:

$$[R^3, R^4, R^5, NH]^+ - [O_3S-C(R^2, COY)-C(R, R^1)-COX]$$

where:

R, $R^1$ and $R^2$ are hydrogen or a hydrogen-and-carbon containing group, $R^3$, $R^4$ and $R^5$ are selected from hydrogen and a hydrogen-and-carbon containing group of at least 12 carbon atoms, at least one of them being a said hydrogen-and-carbon containing group containing at least 12 carbon atoms, X is $-OR^6$, $-NR^7R^8$, or $[O-]^-+[NHR^9R^{10}R^{11}]$ or an alkylene glycol linkage group, and Y is $-OR^{12}$, $-NR^{13}R^{14}$, or $[-O]^-+[NHR^{15}R^{16}R^{17}]$ where $R^6$, $R^7$, $R^8$, $R^9$, $R^{10}$, $R^{12}$, $R^{13}$, $R^{14}$, $R^{15}$ and $R^{16}$ are hydrogen or a hydrogen-and-carbon containing group, and $R^{11}$ and $R^{17}$ are hydrogen-and-carbon containing groups.

2. A composition according to claim 1 in which the liquid hydrocarbon is a fuel oil.

3. A composition according to claim 1 wherein the amine salt has the formula

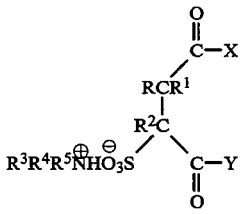

wherein

R, $R^1$ and $R^2$ are hydrogen or a hydrogen - and carbon-containing group;

$R^3$ and $R^4$ are hydrogen or hydrogen - and carbon containing groups containing at least 12 carbon atoms;

$R^5$ is a hydrogen-and carbon containing group containing at least 12 carbon atoms;

X is $-OR^6$, $-NR^7R^8$ or $[-O]^-+[NHR^9R^{10}R^{11}]$ and

Y is $-OR^{12}$, $-NR^{13}R^{14}$ or $[-O]^-+[NHR^{15}R^{16}R^{17}]$ where $R^6$, $R^7$, $R^8$, $R^9$, $R^{10}$, $R^{13}$, $R^{14}$, $R^{15}$ and $R^{16}$ are hydrogen or hydrogen and carbon containing groups, provided $R^6$ and $R^{12}$ cannot both by hydrogen; and $R^{11}$ and $R^{17}$ are hydrogen - and carbon containing groups;

provided that $R^3$, $R^4$ and $R^5$ cannot all be alkyl groups.

4. A composition according to claim 1 wherein at least one of the R groups and X and Y contains at least six carbon atoms.

5. A composition according to claim 1 wherein $R^1$ and $R^2$ are hydrogen.

6. A composition according to claim 1 wherein R is a straight or branched chain alkyl group containing 10 to 20 carbon atoms.

7. A composition according to claim 1 wherein at least one of $R^3$ and $R^4$ is hydrogen.

8. A composition according to claim 1 wherein the groups $R^3$ and $R^5$ are $C_{14}$ to $C_{22}$ alkyl groups.

9. A composition according to claim 1 wherein X is $-OR^6$ and Y is $-OR^{12}$ and $R^6$ and $R^{12}$ are linear long chain alkyl, containing 10 to 22 carbon atoms.

10. A composition according to claim 1 wherein X is $-OR^6$ and Y is $-NR^{13}$ or X is $-NR^7R^8$ and Y is $-OR^{12}$ in which $R^6$ and $R^{12}$ are linear long chain alkyl containing 10 to 22 carbon atoms and $R^7$, $R^8$,1 $R^{13}$ and $R^{14}$ are $C_{14}$ to $C_{22}$ alkyl groups.

11. A composition according to claim 1 wherein X is $-NR^7R^8$ and Y is $-NR^{13}R^{14}$ in which $R^7$, $R^8$, $R^{13}$ and $R^{14}$ are $C_{14}$ to $C_{22}$ alkyl groups.

12. A composition according to any one of claims 2 to 7, wherein the amine salt has the formula:

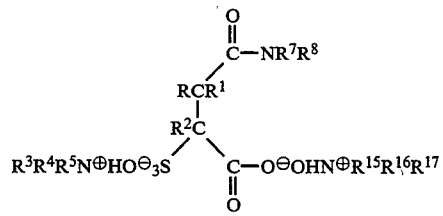

wherein $R^7$, $R^8$, $R^{15}$, $R^{16}$ and $R^{17}$ are $C_{14}$ to $C_{22}$ alkyl groups.

13. A composition according to claim 2 wherein the fuel oil is a distillate fuel oil boiling in the range 120° C. to 450° C. and having a cloud point between −30° C. and 5° C.

14. A composition according to claim 1 wherein the amount of amine salt is between 0.0001 and 5.0% by weight based on the weight of fuel oil.

15. A composition according to claim 1 containing in addition a polymeric low temperature flow improver for fuel oils.

16. A composition according to claim 1 containing in addition a monomeric low temperature flow improver for fuel oils.

17. An additive concentrate comprising 10 to 90 wt. % of a solvent and 90 to 10 wt. % of an amine or diamine salt of (a) a sulphosuccinic acid, (b) an ester or diester of a sulphosuccinic acid (c) an amide of a diamide of a sulphosuccinic acid or (d) an ester-amide of a sulphosuccinic acid; and wherein said amine or diamine is selected from primary, secondary or tertiary amines having hydrogen and carbon-and-hydrogen groups containing at least 12 carbon atoms.

18. An additive concentrate according to claim 17 also containing a polymeric low temperature flow improver for distillate fuels.

19. An additive concentrate according to claim 17 also containing a monomeric low temperature flow improver for distillate fuels.

* * * * *